United States Patent [19]

McBride

[11] Patent Number: 4,600,079

[45] Date of Patent: Jul. 15, 1986

[54] NON-SLIP RESILIENT LADDER SUPPORT

[76] Inventor: Thomas D. McBride, 559 Chestnut St., Westwood Post Office, N.J. 07675

[21] Appl. No.: 790,990

[22] Filed: Oct. 24, 1985

[51] Int. Cl.[4] ..... E06C 5/36; E06C 7/48

[52] U.S. Cl. ..... 182/108; 182/214; 248/210

[58] Field of Search ..... 182/107, 108, 214; 248/210

[56] References Cited

U.S. PATENT DOCUMENTS

| | | | |
|---|---|---|---|
| 1,964,067 | 6/1934 | Leach | 182/108 |
| 2,815,160 | 12/1957 | Gilmour | 182/214 |
| 2,904,128 | 9/1959 | Boham | 182/108 |
| 2,925,877 | 2/1960 | Wright | 182/108 |
| 3,037,579 | 6/1962 | Barrow | 182/107 |
| 3,062,319 | 11/1962 | Wright | 182/108 |
| 3,115,212 | 12/1963 | Keatley | 182/108 |
| 3,662,856 | 5/1972 | D'Amico | 182/108 |
| 3,993,163 | 11/1976 | Barrett | 182/108 |
| 4,469,193 | 9/1984 | Rumsey | 182/107 |
| 4,469,194 | 9/1984 | McBride | 182/107 |

*Primary Examiner*—Reinaldo P. Machado
*Attorney, Agent, or Firm*—Ralph R. Roberts

[57] ABSTRACT

This invention pertains to a protector ladder support used in pairs and removably mountable on stiles of a ladder. These protectors have non-slip resilient face portions adapted to engage the means against which the ladder is leaned. These supports have formed slots sized and shaped to receive and retain the rungs of a ladder. These supports have retaining members so that the protectors may be mounted and retained in a selected position. Conventionally, each protector is of sheet metal and the slots are usually at about thirty degrees and have a selected retaining means adapted to engage a rung of a ladder to retain the protector on the ladder stile. In one embodiment a pin or rod is disposed to engage a rung. In yet another embodiment a pivoted hook is disposed to engage a rung of a ladder and in yet a third embodiment a pivoted tab having a sloped engaging edge is adapted to be swung into a retaining condition and position.

12 Claims, 8 Drawing Figures

NON-SLIP RESILIENT LADDER SUPPORT

CROSS-REFERENCE TO RELATED U.S. PAT. NO. 4,469,194

This invention pertains to non-slip ladder attachments to insure that ladders, particularly extension ladders are provided with non-slip engaging portions adapted to retain a placed ladder in position. My U.S. Pat. No. 4,469,194 provides an attachment for a rung whereas this invention is directed to protectors attached to the stiles or rails of the ladder.

BACKGROUND OF THE INVENTION

1. Field of the Invention

With reference to the classification of art as established in and by the United States Patent Office, this invention is believed to be found in the general class of "Fire Escapes, Ladders and Scaffolds", and particularly to attachable members having resilient facing portions that are adapted to engage walls and gutters of a house. This invention discloses a particular embodiment and variations thereof. Preferably, this invention provides like pairs arranged as mirror images and disposed to be removably carried on the stiles of the ladder.

2. Description of the Prior Art

Ladders and particularly extension ladders are well known and are usually constructed of wood, aluminium and magnesium. As commercially produced, the stiles are alike and the rungs are substantially alike and of regular spacing and disposition from the edge. In my reference patent in Class 182, subclasses 107 and 108, the following patents are noted: U.S. Pat. No. 1,964,067 as issued 6/1934 to Leach; No. 2,904,128 as issued 9/1959 to Boham; No. 2,925,877 as issued 2/1960 to Wright; No. 3,037,579 as issued 6/1962 to Barrow; No. 3,062,319 as issued 11/1962 to Wright; No. 3,115,212 as issued 12/1963 to Keatley; No. 3,662,856, as issued 5/1972 to D'Amico, and No. 3,993,163 as issued 11/1976 to Barrett. In these and prior art references the protective devices are directed to protective devices attached at the end of the stile rather than intermediate the length. Usually these devices are for ladders of great extent and the protective devices are to prevent sharp ends of the ladders (usually sharp metal) from damaging any engaging wall surface. This protection is usually constucted with rubber boots, taped ends or wheels but these do not provide the control of this invention.

SUMMARY OF THE INVENTION

This invention may be summarized, at least in part, with reference to its objects.

It is an object of this invention to provide, and it does provide, attachment devices to each stile of a ladder using two of the rungs of this ladder and providing a face portion with resilient properties so as to protect a surface against which the ladder is leaned.

It is a further object of this invention to provide, and it does provide, ladder stile protective members formed as mirror images and with angled slots sized to provide a diagional entrance for two adjacent rungs which then move to a receiving arcuate stop at the end of each slot. These stile protective members have open ends so that they may be positioned on two adjacent rungs and retaining means is provided for each rung in each slot.

In brief, this non-slip resilient ladder rail protector contemplates that pairs of protectors are used with each ladder. The protectors are made of sheet aluminium with slots removed by die means. Ears are formed in and by the same or other dies and provide tabs that are bent to provide a desires channel within which the stile of the ladder may be positioned. Right angle bends are provided in each protector and one protector has a right angle bend and the other protector has a left angle bend. The outer bend extension has a sponge rubber member attached as by cement or other securing means. Securing of the protector to the stile utilizes the rungs of the ladder and the formed slots which provide sloped guideways for receiving and retaining two rungs of the ladder. These rungs are maintained in position on the mounted protectors by engaging means that is manipulated to engage a rung after positioning of the protector.

In addition to the above summary the following disclosure is detailed to insure adequacy and aid in understanding of the invention. This disclosure, however, is not intended to cover alternate constructions no matter how these are disguised by variations in form or additions. For this reason there has been chosen a specific embodiment of protectors made of sheet metal with three means of securing the protectors to the rungs of a ladder, each protector having an exterior face portion on which there is a non-slip resilient member as adopted for use against a wall or gutter and providing an extended longitudinal surface. This specific embodiment and the three means for retention to rungs of the ladder have been chosen for the purposes of illustration and description as shown in the accompanying drawings wherein:

DESCRIPTION OF THE PREFERRED EMBODIMENT

Figure 1:
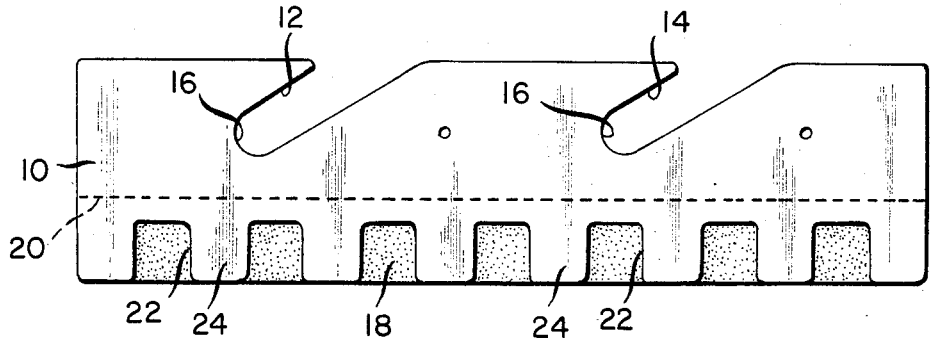
FIG. 1 represents a plan view of a die cut sheet of metal providing one member of a pair of ladder protectors.

The stile or rail protectors of this invention are made and used as mirror images. It is essential that the protectors be removable and attachable at a selected position of the ladder. The rungs of the ladder are conventional and spaced so that a protector can be positioned on two adjacent rungs and with the stiles and the protectors thereon engaging a roof line, gutter or the like. The protectors are conventionally made of sheet metal as right and left hand members and have a bent over longitudinal portion which is at substantially right angles to a flat surface extent. The resilient support surface portion is conventionally attached by an adhesive means. As the width of a stile varies from manufacturer to manufacturer there is provided tabs that are selectively bent by the user to provide a channel guide.

In the drawings it is noted that a flat sheet of metal such as aluminium and generally identified as 10 has a generally rectangular shape. Two slots 12 and 14 in this sheet are provided by die means. These slots are shown as at about thirty degrees inclination from the horizontal but the angle may be greater. It is noted that each slot is of sufficient width to easily accommodate the rung of a ladder when slid therealong. The inner ends of these slots are formed with semi-circular cutouts 16 which are adapted to engage and retain a rung of the ladder. When slid in place the protector is retained by securing means engaging the rung of the ladder at one side thereof. The resilient support surface member is identified as 18 and preferably is about one-half inches in thickmess.

This resilient portion may be only as wide as the right angle bent portion 20 which is to rest against the edge of the stile. The resilient portion may also extend to the extreme outer limit of this bent portion if desired. A series of notches 22 are formed in the bent portion 20 and provides tabs 24 which are bent by the user to form a slide channel for the stile of the ladder. For the purposes of identification the stile of the ladder is 30 and the rungs are 32.

There are three means of retaining the ladder protector on the ladder. First is a tab member 40 which is pivotally retained by a rivet 42 extending through holes positioned and formed in both the sheet metal member 10 and in the tab member 40. One tab is provided for each slot but if desired only one tab member may be supplied for each protector and the use of one or two tabs on each protector is not intended to be patentably limiting. Also shown is a hook 46 which is also retained by a rivet 48 in the flat expanse of the metal member 10. In yet another embodiment is shown a pin or nail 50 which is passed through holes in upper and lower retainers 52 and 54. These pins are disposed to pass behind a rung 32 and retain the protector when mounted on the ladder. The upper and lower retainers may be of sheet metal formed from scrap portions from the removed portions of the protector or may be separately produced by other means. These retainers may be secured by welding, soldering or adhesive as the producer determines.

Although the preferred embodiment illustrates the use of tabs which are bent to suit the width of a ladder stile this does not preclude providing an adjustable angle held in place by screws. This angle may be adjusted initially and establish the channel width. This channel width as established provides slidable retention of the protector on the stile of the ladder during sideways positioning whereat without a channel retention the friction may cause unwanted dislodgement. The protectors are used in pairs for a leaned ladder for flat surfaces. When the ladder is to be used against a tree or the like the non-slip ladder support of my U.S. Pat. No. 4,469,194 may be used. The ladder may have both devices secured thereto absent alteration of the intended use of the ladder. The resilient material is anticipated to be foamed plastic but any soft material that may be attached by cement or the like may be used. The disclosed protectors are anticipated to be of sheet metal but this is not intended to preclude the use of wood or plastic.

EMBODIMENT OF FIG. 1

In FIG. 1 the sheet metal member 10 is depicted with two slots 12 and 14 which are sized to receive and retain rungs of a ladder to be later identified. These slots are shown at an angle of about thirty degrees but greater angular disposition may be made and angularity has no patentable distinction. The inner end of the slots are provided with semi-circular cut-outs or configurations 16. After the blanking of the member 10 has been achieved, a resilient support surface member 18 is secured to this member 10 as by adhesive. A bent portion at a right angle 20 is conventionally provided by a die. The assembled protectors are a pair with one half of said pair bent to the right and the other half of the pair bent to the left. At the time of blanking the sheet metal member, notches 22 are formed with the extending attached portions providing tabs 24.

EMBODIMENT OF FIG. 2

Figure 2:
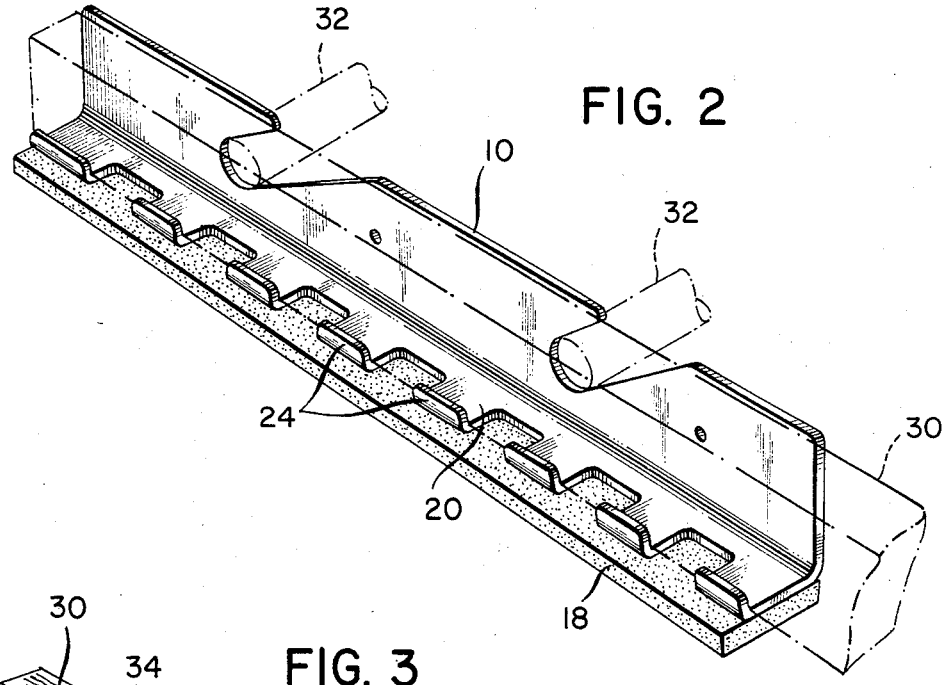
FIG. 2 represents an isometric view, partly diagrammatic, and showing the sheet metal protector member with a portion thereof bent to form a right angle and with tab portions further bent to provide channel retainers, this protector having a resilient face portion attached as by adhesive.

In FIG. 2 the protector is shown ready for attachment to the stile or rail of a ladder. Metal member 10 is shown with a bent angular portion 20 and the tab portions 24 are bent by pliers of the user to form a channel of determined width. In most ladder constructions stiles identified as 30 are from seven-eights of an inch to one and three-eights inches in thickness. The bent tab portions 24 are made to provide a sliding channel for the ladder stile. The rungs 32 are usually about three-quarters to seven-eighths inches in diameter and most are round but there are some rungs having irregular shapes so that the width of the slots 12 and 14 are merely a matter of preference and configurations and can be made to suit a large number of ladder constructions. It is noted that the resilient support surface material 18 is conventionally an extruded strip usually about one-half an inch in thickness and usually about as wide as the lower bent extending portion but may be made narrower if desired. It is only required that the attached resilient surface material be secured to this protector so that unwanted movement of the ladder when leaned against a support surface does not occur.

EMBODIMENT OF FIGS. 3 AND 4

Figure 3:
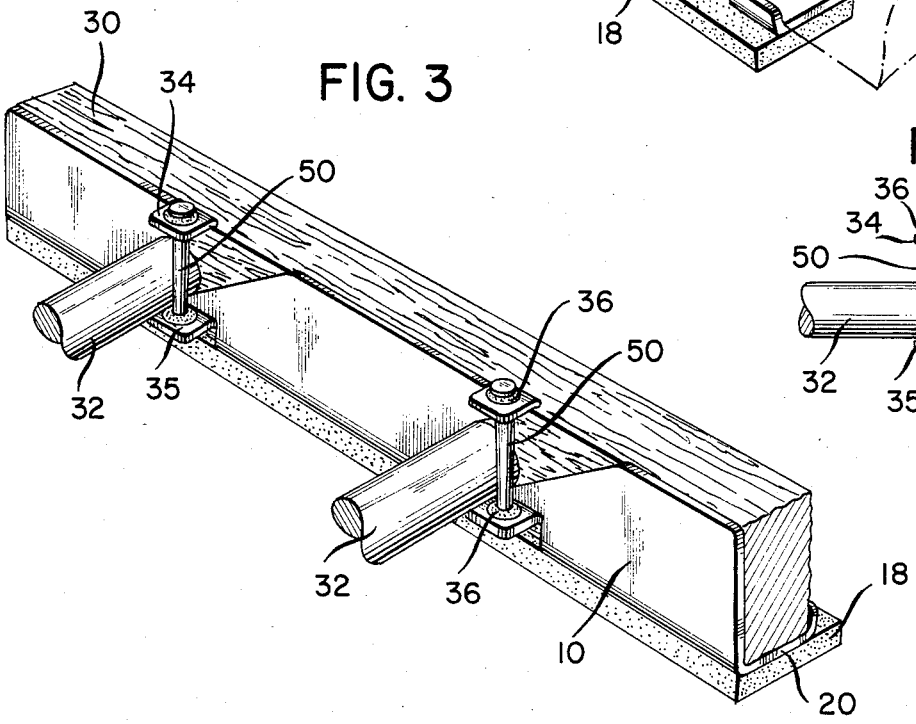
FIG. 3 represents an isometric view, partly diagrammatic and showing a ladder protector using pins for retention of this protector to and on the rungs of a ladder.
Figure 4:
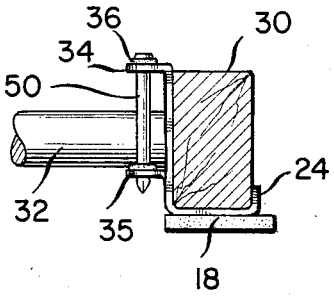
FIG. 4 represents an end view so as to illustrate the placement of the protector of FIG. 3 on the ladder.

In FIGS. 3 and 4 is depicted one means of engagement or securing the ladder protector to the rungs 32 of a ladder. As seen, the plate 10 has the sloped cutouts for the rungs as in FIG. 1 with the bent portion 20 and tabs 24 forming and providing the desired trough guide. Inwardly extending ears 34 and 35 are shown as formed from the sheet metal 10 but these ears may be separately attached by means such as rivets, welding or epoxy cement. These upper and lower ears are shown with resilient liner portions 36 adapted to tightly retain a pin or nail 50 which passes adjacent the inwardly extending rung 32. It is to be noted that in FIGS. 3 and 4 the stile 30 is shown as wood but metal ladders are also contemplated. The positioning of the ears and holes in said tabs is dependent on the size of the rung 32 and the pin 50. The resilient support member 18 extends the length of each protector.

EMBODIMENT OF FIGS. 5 AND 6

Figure 5:
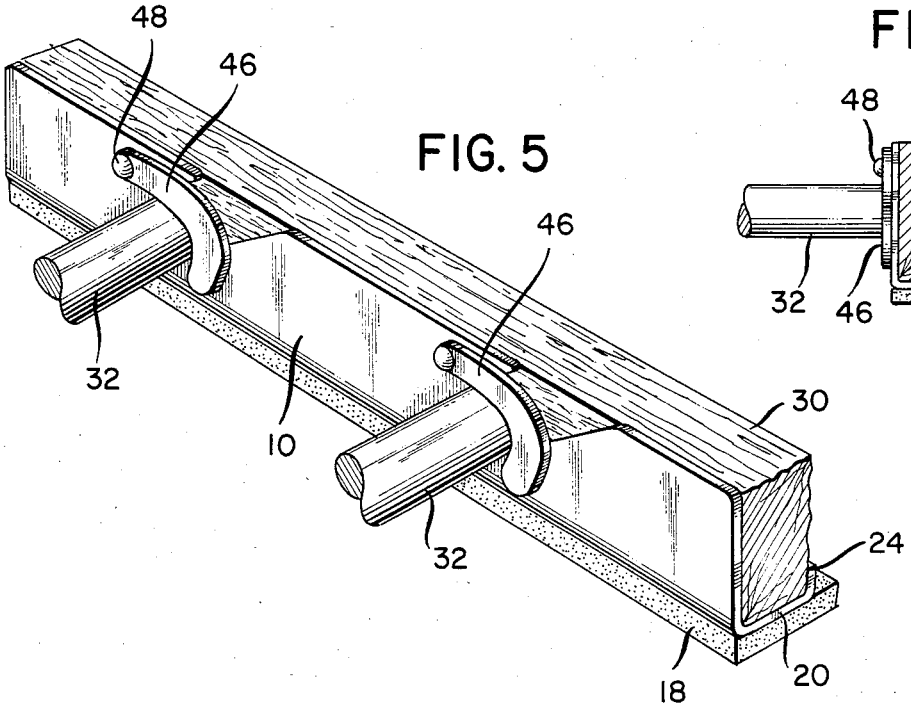
FIG. 5 represents an isometric view, substantially like that of FIG. 3 but with the retention provided by and with hooks.
Figure 6:
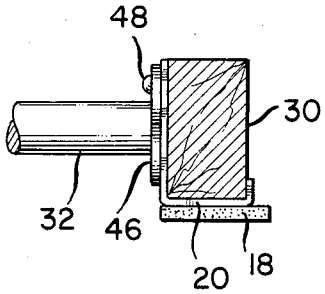
FIG. 6 represents an end view of the ladder protector of FIG. 5 and showing the hook in securing position.

In FIGS. 5 and 6 there is depicted another means for securing the protector to the rungs 32 of the ladder. A metal hook 46 is retained for pivotal swinging by a rivet 48. Each protector has a hook 46 for each slot. As seen in FIG. 6 the hook is secured so as to be adjacent the inner face of the metal member 10. In all other respects the member 10 is as shown in FIG. 2.

EMBODIMENT OF FIGS. 7 AND 8

Figure 7:
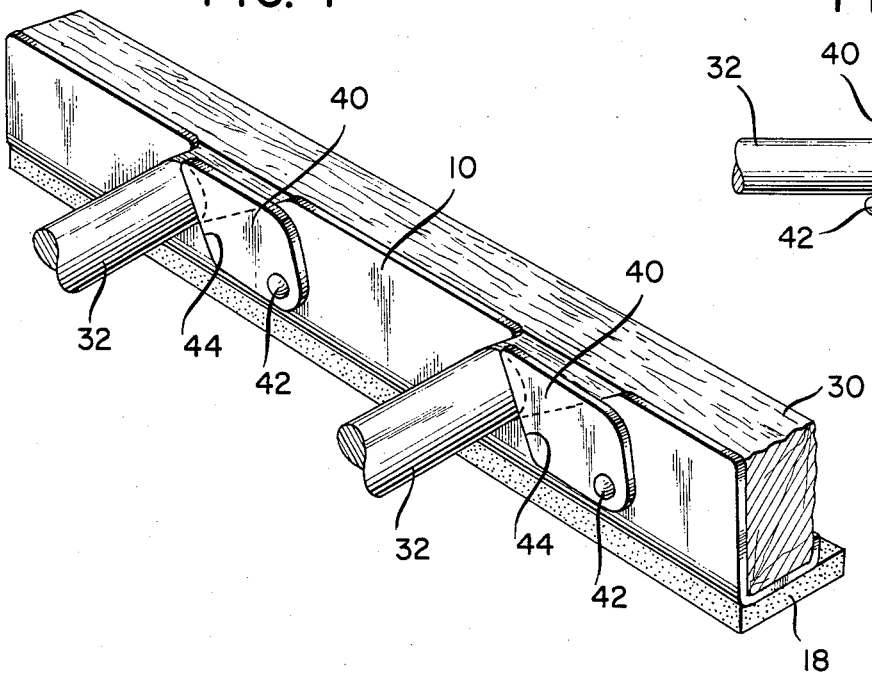
FIG. 7 represents an isometric view similar to FIGS. 3 and 5 but with the securing of the protector by a plate-like retainer.
Figure 8:
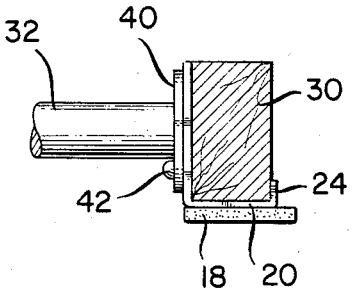
FIG. 8 represents an end view of the ladder protector of FIG. 7 with the securing of the protector with actuating said plate-like members.

Referring next and finally to FIGS. 7 and 8, there is shown an alternate means for retaining the protector on the ladder. A metal member 10 is substantially like that shown in FIG. 2 but the retention of the protector is by means of a swinging plate tab member 40 secured by a revet 42. This plate tab retainer has a sloped forward or front portion 44 that is adapted to engage the rung 32 of the ladder when rotated into retaining position. This rivet is adapted to retain the tab 40 in the swung position and a friction washer may be used to provide this action. It is noted that the slope 44 is so configured as to engage and urge the rung 32 into seating retention in the semi-circular cut-out 16.

No matter what protector and securing means is employed, the protectors are supplied and used as mirror pairs. The plate 10 is always to the inside face of the stile. The bend is always toward the outside and the turned tabs 24 are sized to provide a sliding trough for the stile of the ladder. The resilient support surface is usually foam rubber but is not limited thereto as long as resilience is provided. This resilience is desired to accommodate irregular surfaces and particularly to not damage a surface against which the ladder is leaned.

Although shown as made of sheet metal a large quantity of protectors may be of molded plastic where similar troughing sizes are to be accommodated. It is also contemplated that wood may be utilized and that tabs 24, rather than bent by the user, may be pre-bent or a retainer angle removably secured to the bottom extent may also be provided. It is intended that a pair of protectors be provided as right and left hand members and that the resilient facing be in the same plane. The rungs of the ladder are employed so that the interior of the ladder is only slightly diminished in width access distance. The protectors are mounted on the same rungs whose spacing on centers are quite similar as established by the manufacturers.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the ladder protection devices may be constructed or used.

While a particular embodiment of the ladder protectors and various means of securing to a rung have been shown and described it is to be understood the invention is not limited thereto and protection is sought to the broadest extent the prior art allows.

What is claimed is:

1. A non-slip resilient ladder support disposed to be used in pairs with each removably attachable to the stile of a ladder to protect the surface or surfaces against which the ladder is rested, each of said supports including:

(a) a side plate member disposed to be removable contiguous with inner side surface of a ladder stile, this side plate member having at least two substantially equally sized and angled slots sized to slidably receive and retain adjacent rungs of the ladder;

(b) a stile engaging edge portion attached to and extending from said side plate member and substantially normal thereto;

(c) a resilient support surface member attached to the outer surface of the stile edge engaging portion;

(d) means for providing a retaining member adapted to form a longitudinal and slideable guideway for the stile of a ladder, and (e) means for removable securing and retaining said support to adjacent rungs of said ladder, the retained support presenting said resilient support surface member to the fixed surface against which the ladder is leaned.

2. A ladder support as in claim 1 in which the side plate member and the stile engaging edge portion are of sheet metal with said stile engaging edge portion integral with said side plate and this stile edge engaging portion bent substantially normal to the side plate.

3. A ladder support as in claim 2 in which the means for securing and retaining the ladder support in said guideway are tab portions provided in the integral edge portion, said tab portions of an extent that those extending portions beyond the stile are adapted for bending into portions which are slidably disposed adjacent the inner surface of the retained stile.

4. A ladder support as in claim 3 in which the extending tabs are intermediate cutouts formed in the sheet metal member with said cutouts interposed between tab portions.

5. A ladder support as in claim 2 in which the means for securing and retaining of the support to the ladder includes upper and lower ears protruding inwardly from the sheet metal member and with each ear having apertures that are aligned with each other and with these apertures adapted to removably receive and retain a pin or rod adapted to be mounted therein and to engage a side of the rung to provide retention of said support.

6. A ladder support as in claim 5 in which the apertures in the ears are provided with resilient inserts providing inhibiting means for the unwanted movement of the pin or rod in said ears.

7. A ladder support as in claim 2 in which the means for securing and retaining of the support to the ladder includes a hook having a shank end secured to the sheet metal member by a rivet or the like, this hook adapted to be swung into rung retaining condition when the support is positioned on the rungs.

8. A ladder support as in claim 7 in which the hooks are of sheet metal and there is friction means provided so that the hook is movable only with an applied force.

9. A ladder support as in claim 2 in which the means for securing and retaining of the support to the ladder includes a plate-like tab member having an aperture formed therein and a rivet is used to retain this plate-like member to the sheet metal member.

10. A ladder support as in claim 9 in which the plate-like tab member has a sloped face portion which is so disposed and configured as to provide with an applied force a positive engagement of the rung of said ladder.

11. A ladder support as in claim 10 in which the rivet used to retain each plate-like tab member is also provided with friction means that inhibits movement except with an applied force.

12. A ladder support as in claim 2 in which the sheet metal is of aluminium.

* * * * *